US006202383B1

(12) United States Patent
Reiter

(10) Patent No.: US 6,202,383 B1
(45) Date of Patent: Mar. 20, 2001

(54) DEVICE FOR HOLDING GLASS PANES

(75) Inventor: Rolf Roland Reiter, Bodnegg (DE)

(73) Assignee: Krauss Innovation Ltd., Bridgewater (CA)

( * ) Notice: Subject to any disclaimer, the term of this patent is extended or adjusted under 35 U.S.C. 154(b) by 0 days.

(21) Appl. No.: 09/341,919

(22) PCT Filed: Jan. 21, 1998

(86) PCT No.: PCT/DE98/00171

§ 371 Date: Sep. 20, 1999

§ 102(e) Date: Sep. 20, 1999

(87) PCT Pub. No.: WO98/31888

PCT Pub. Date: Jul. 23, 1998

(30) Foreign Application Priority Data

Jan. 29, 1997 (DE) ..... 197 01 862

(51) Int. Cl.[7] ..... E04B 1/61

(52) U.S. Cl. ..... 52/770; 52/771; 52/772; 52/761; 52/474

(58) Field of Search ..... 52/770, 771, 772, 52/761, 474

(56) References Cited

U.S. PATENT DOCUMENTS 1,776,231 * 9/1930 Dreher ..... 52/474
4,750,310 6/1988 Holcombe .

FOREIGN PATENT DOCUMENTS 36 39 515 6/1988 (DE) .
38 43 619 6/1990 (DE) .
39 27 653 3/1991 (DE) .
93 02 366 6/1993 (DE) .
93 02 820 9/1993 (DE) .
295 04 581 8/1995 (DE) .
44 36 483 4/1996 (DE) .
196 23 797 12/1996 (DE) .
296 12 013 2/1997 (DE) .
0 617 190 9/1994 (EP) .

* cited by examiner

*Primary Examiner*—Carl D. Friedman
*Assistant Examiner*—Christy M. Syres
(74) *Attorney, Agent, or Firm*—Evenson, McKeown, Edwards & Lenahan, P.L.L.C.

(57) ABSTRACT

The invention proposes an arrangement for the construction of a structure from panel-like material, for example a glazed weatherproof structure, in the case of which no framing of the panels (21, 22) is necessary and the construction can be carried out with little outlay. This is achieved according to the invention in that there is provided a support (2) which can be fastened on a supporting tube (3) and by means of which at least panels (21, 22) are retained, the supporting tube (3) having a slot for the variable installation of the support (2).

18 Claims, 14 Drawing Sheets

DEVICE FOR HOLDING GLASS PANES

The invention relates to an arrangement for securing glass panels, in particular as a weatherproof structure for outdoor areas such as terraces, balconies or the like, according to the preamble of claim 1.

Outdoor areas such as terraces, balconies or the like are usually either open, and thus exposed to the weather; or protected by appropriate wind-screening means, although this obscures the view. From time to time, glass panels are also used as a wind-screening means in which said glass panels are fastened on the windward side of the appropriate outdoor area.

Furthermore, so-called conservatories, in the case of which an outdoor area is fully glazed in a sealed manner, are very common. Such conservatories serve as a recreational area in particular in the transitional periods in the spring and in the fall, during which times the usually low temperatures mean that spending time out in the open is only possible if appropriate clothing is worn.

These closed conservatories thus have a high-outlay thermopane glazing, in order to ensure certain temperature insulation in relation to the exterior surroundings. In warmer weather, in particular in the summer, this means that a considerable amount of heat is introduced into the conservatory, with the result that it is no longer comfortable to stay in this conservatory without an appropriate shade-providing system. In addition, a conservatory as mentioned above constitutes a closed area in the case of which sufficient ventilation has to be ensured.

In the case of the known conservatories, a frame construction comprising supports and so-called crossbars is erected, the panels being inserted therein. Said frame construction is designed specifically for the envisaged structure, which involves a certain outlay in terms of time and money.

The documents DE 93 02 820.2, U.S. Pat. No. 4,750,310 and DE 39 27 653 have disclosed arrangements which are intended for securing glass panels, wooden panels or the like for erecting structures and in the case of which use is made of supporting tubes and securing means which are provided on the supporting tubes and are intended for securing the panels.

No provision is made in any of the three documents for securing additional components on the respective supporting tubes.

In contrast, the object of the invention is to propose an arrangement of the type mentioned in the introduction in the case of which additional fastening elements may be provided, with little outlay, at any desired location on the supporting tube.

In contrast, the object of the invention is to propose an arrangement which is intended for securing panel-like material, in particular glass panels, and which can be realized with considerably reduced outlay in comparison with know arrangements and can be used flexibly for different purposes.

Taking as a departure point the prior art mentioned in the introduction, this object is achieved by the defining features of the claims.

Advantageous embodiments and developments of the invention are possible by virtue of the measures mentioned in the subclaims.

An arrangement according to the invention for securing panel-like material such as glass panels etc. comprises a supporting tube which has a longitudinal slot on which a retaining element can be fastened in order to secure the support on the supporting tube. In such a longitudinal slot, it is possible to fasten the support, for securing the panels, at any desired position in the longitudinal direction of the supporting tube. This results in flexible use of the arrangement. The support may be arranged in accordance with the design of the panel which is to be secured. Such an arrangement can be used to retain all types of panels for a wide range of different purposes.

An arrangement according to the invention for securing panel-like material such as glass panels etc. comprises a supporting tube which has a longitudinal slot on which a retaining element can be fastened in order to secure the support on the supporting tube. In such a longitudinal slot, it is possible to fasten the support, for securing the panels, at any desired position in the longitudinal direction of the supporting tube, this resulting in flexible use of the arrangement. The support may be arranged in accordance with the design of the panel which is to be secured. Such an arrangement can be used to retain all types of panels for recesses in the outer wall of the supporting tube, and inserted through the additional longitudinal profile. Such a structural element is be fastened for example by a screw which, then by way of the profile groove, can likewise be countersunk in the interior of the supporting tube in relation to the outer wall.

In an advantageous development of the invention, the supporting tube is provided with a termination profile which is intended for the profile groove and by means of which the profile groove can be covered in the regions in which no support has been installed. This, on the one hand, determines the appearance of the arrangement and, on the other hand, closes off the profile groove toward the outside, with the result that no dirt or the like can penetrate.

In a particularly advantageous embodiment of the invention, an end-side covering is provided on the supporting tube. This, on the one hand, visually closes off the supporting tube and, on the other hand, prevents dirt, rainwater or the like from being able to penetrate into the supporting tube from above.

In a development of this embodiment, two end-side coverings of two supporting tubes are fastened on one another. This makes it possible to use two supporting tubes in extension of one another.

It is preferable, for example with the aid of two end-side coverings as mentioned above, for two supporting tubes to be designed such that they can be fastened at the end sides with the profile grooves rotated in relation to one another. This makes it possible for the installation plane of the panels retained by the respective supporting tubes to be rotated correspondingly in relation to one another.

Also preferably provided is is a support which can be fastened on a supporting tube and by means of which at least two adjacent panels are retained at the same time. By means of such an arrangement, it is possible to construct a structure in panel-like material e.g. a glass structure or a glazed weatherproof structure, with little outlay and without the individual panels being framed. In this case, the panels either may be arranged with open interspaces, which results in correspondingly good through-ventilation, or else may also be sealed in relation to one another via sealants which can be introduced subsequently, this resulting in a closed structure.

In an advantageous embodiment, said support is designed so as always to ensure that a gap forming between the adjacent panels is located level with the supporting tube and runs essentially parallel thereto.

This arrangement allows, for example, an air gap through which in particular even an enclosed area can be constantly ventilated, an air stream which reaches the air gap and penetrates within being broken up at the supporting tube located behind. Such a weatherproof structure is thus protected against draughts, good ventilation always being ensured. Using the supporting tube as something of a wind-break considerably reduces the number of parts required. This considerably reduces the production outlay for erecting a weatherproof structure according to the invention, the appearance of the weatherproof structure being improved at the same time.

However, a construction of mutual overlapping of adjacent panels would also be conceivable, and there is likewise no possibility of any direct draughts into the interior of the structure in the case of open interspaces.

The support is advantageously designed such that the distances of each panel from a plane which runs through the center point of the supporting tube and is parallel to the panel are essentially equal. This considerably improves the appearance of the structure.

Furthermore, the support is preferably designed such that the bisector of the angle between two adjacent panels intersects the center axis of the supporting tube. As a result, the supporting tube is located in the main wind-inlet direction, directly behind the air gap, at the same distance from the two panels, as a result of which the wind-breaking function is improved.

An arrangement according to the invention advantageously provides means for adjusting the position of a panel. These adjustment means cover, for example, adjustment of the position of the support in relation to the panel, adjustment of the position of the support in relation to the supporting tube and/or adjustment of the distance of the panel from the supporting tube.

In an advantageous embodiment, a support according to the invention is provided with a retaining bolt which passes through appropriate receiving means of the panel which is to be retained. Such receiving means may be provided, for example, as bores in the panel or else as specifically designed receiving parts, e.g. internally threaded metal inserts which have recently become available, for example, in laminated-safety-glass panels.

It is advantageous here for the distances of the receiving means from the side border of the panel and from the gap to be essentially equal. This further improves the appearance of the construction.

The distance of the panel from the support can be adjusted, for example, in that the retaining bolts can be fastened in the support in a variable position in terms of its axial direction. In the case of a threaded bolt, this can be carried out, in a straightforward embodiment, by one or more adjustment nuts.

The possibility of adjusting the panel in a direction parallel to the panel plane can be realized, for example, by a bearing element which is used eccentrically in relation to the axis of the retaining bolt and is introduced into a receiving means, for example a bore of the panel. Depending on the position of the eccentricity in relation to the retaining bolt, the height or the lateral offset of the panel changes here in relation to the retaining bolt. Such an eccentric bearing element may be realized, for example, by a spacer sleeve with an eccentric through-passage bore for the retaining bolt.

Different supports are advantageously provided with different angles. As a result, it is possible to set an appropriate angle between two adjacent panels in dependence on the selection of the supports used.

Furthermore, a particular embodiment provides a support with an adjustment device for the variable setting of the fastening angle of a panel, this increasing the number of the various possible uses of the support.

Sealing profiles are advantageously provided for the roof region of a construction according to the invention. In the case of installation in the roof region, an air gap according to the invention would be a hindrance since rainwater could penetrate through it. The use of sealing profiles closes off such an air gap in a watertight manner, it still being possible to use a support of the type described.

Such sealing profiles may also be used for sealing a wall construction according to the invention, this resulting in a closed area. In particular when using insulating glass, which usually comprises at least two spaced-apart glass panels, it is recommended here for a cross-sectionally circular rubber cord to be positioned in the region of the interspace between the two glass panels and for the rest of the cavities in the gap to be sealed with a sealing compound, for example silicone. It is also possible for the rubber cord to consist of foam rubber such as neoprene, etc.

Vertically overlapping installation is preferably provided in the roof region, it being possible for such an overlap of individual panels to be achieved, for example, by the abovementioned adjustment means or by additional spacers during the installation of a support. It would also be conceivable, however, to provide different supports for this specific application, with the result that the panel which is on top of this location is at a greater distance from the supporting tube than the panel on the bottom.

Elastic retaining elements are advantageously provided for securing the panel. In the case of a glass panel, for example, this compensates for any possible stressing in the glass panel, with the result that breakage of the glass is largely avoided.

In the case of a weatherproof structure erected according to the invention, single glazing is also possible, in contrast to previous conservatories, since thermal insulation is not intended anyway in the case of open air gaps. Single-glazing panels, however, are particularly sensitive to such stressing. According to the invention, each glass panel is retained individually and does not have to be aligned precisely in relation to an adjacent panel. This alone avoids stressing within the glass panels. By virtue of the additional elastic securing means, it is also possible, in the same way as with the abovementioned adjustment means, to provide appropriate compensation within the securing points of individual glass panels.

In contrast to the closed conservatory, a glass structure erected with open gaps provides an area which always has through-ventilation but is protected from the weather. In particular, this area is also protected against penetrating UV radiation. The open construction, in particular with overlapping glass panels in the roof region, also provides, in addition to through-ventilation, an outlet for insects which stray into the interior of the glass structure. As has been mentioned, the open construction makes it possible to have single glazing in the case of which, in addition, no condensation is produced.

The glass structure erected as mentioned above also provides sound insulation, which is improved, in particular, by the elastic retaining elements.

A panel change, in the case of an arrangement with the abovementioned supports, is always possible from the inside, with the result that no exterior scaffolding is necessary. In the case of such a structure, there are no screw-connections on the outside, with the result that certain protection against theft is thus ensured.

For the various securing parts, use is preferably made of a treated aluminum, this ensuring, at the same time, a high loading capacity, a good handling capacity, as a result of the weight being kept low, and long-term corrosion prevention.

BRIEF DESCRIPTION OF THE DRAWINGS

An exemplary embodiment of the invention is illustrated in the drawing and is explained in more detail hereinbelow with reference to the figures.

In the drawing, in specific terms.

DETAILED DESCRIPTION OF THE DRAWINGS

Figure 1:
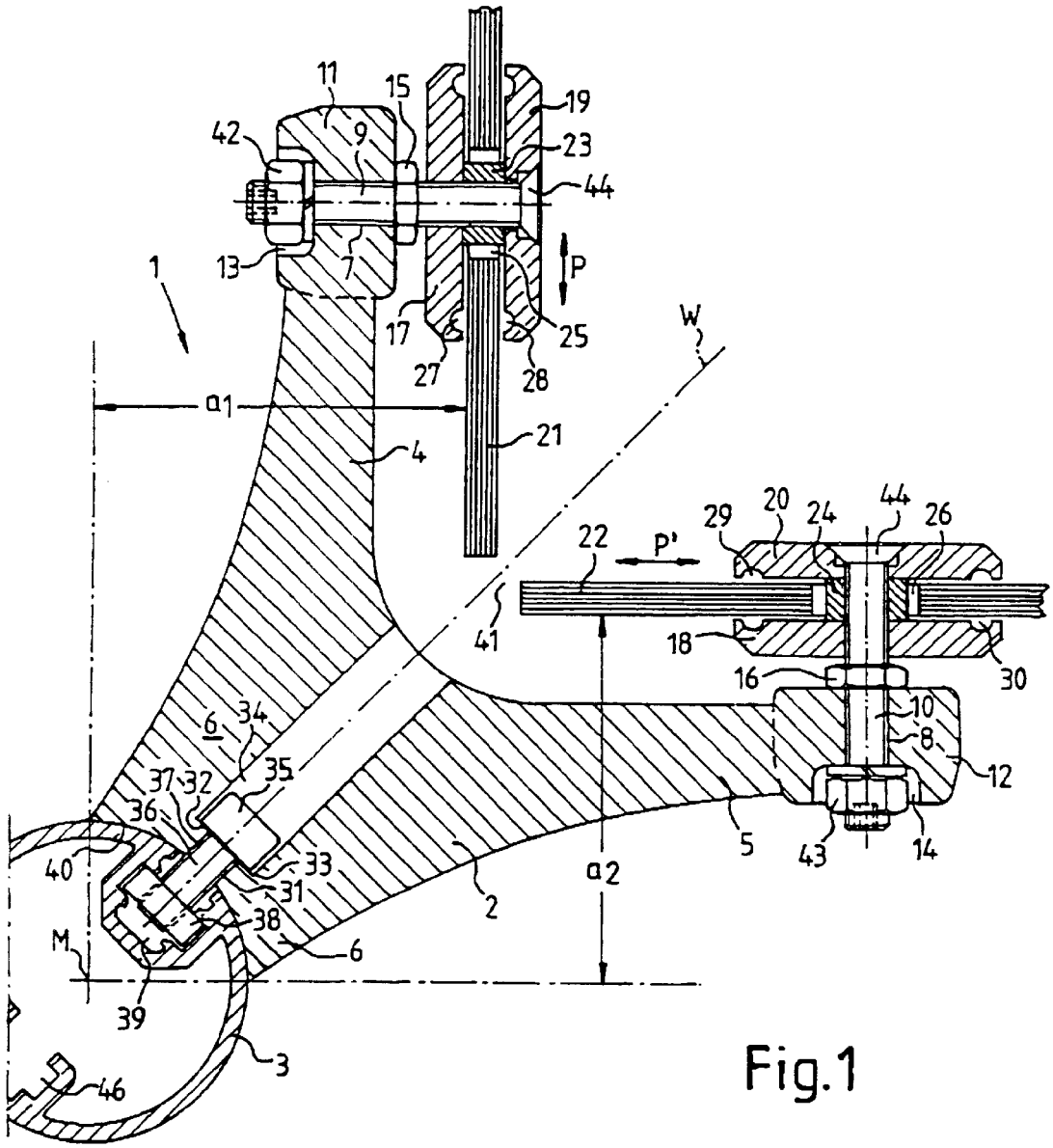
FIG. 1 shows a schematic sectional illustration of an arrangement according to the invention angled at 90°.

The arrangement 1 according to FIG. 1 comprises a support 2 which is fastened on a supporting tube 3. The support 2 branches into two retaining legs 4, 5 which extend from a tube-side section 6. Provided at the ends of the retaining legs 4, 5 are bores 7, 8 which each have a retaining bolt 9, 10 passing through them. In the present case, the bores 7, 8 are provided in end-side reinforcements 11, 12 of the retaining legs 4, 5, said reinforcements additionally having a recess 13, 14 for receiving a screw nut 42, 43 for screwing onto the retaining bolts 9, 10.

The retaining bolts 9, 10 are secured on the retaining legs 4, 5 via a nut 15, 16. Provided at the end of the retaining bolts 7, 8 are in each case one inner retaining disk 17, 18 and in each one outer retaining disk 19, 20. The two retaining disks can be screwed onto the appropriate retaining bolt 9, 10 and each enclose a glass panel 21, 22. The retaining bolt 9, 10 passes through an eccentric sleeve 23, 24 which comes to rest in an appropriate bore 25, 26 of the respective glass panel 21, 22. In the illustration according to FIGS. 1 to 3, the eccentric sleeve is located such that the eccentricity is perpendicular to the drawing plane and thus cannot be seen.

In the vicinity of its circumference, each retaining disks 17, 18, 19, 20 has an annular groove 27, 28, 29, 30 in which an elastic element (not illustrated specifically in the figure), for example a rubber ring, can be positioned.

The tube-side section 6 has a bore 31 which, in the form of an annular shoulder 32, has a cross-sectional widening 33. In the wider section 34 of the bore 31, a screw head 35 butts against the annular shoulder 32. The threaded section of the screw 36 passes through the narrower section 37 of the bore 31 and is screwed into a sliding block 38. The sliding block 38 is mounted in an appropriate longitudinal groove 39 of the supporting tube 3. The bearing surface 40 of the tube-side section 6 of the support 2 has a curvature which is adapted to the circumference of the supporting tube 3.

The support 2 is fastened firmly in the desired position on the supporting tube 3 via the locking screw 36. By virtue of the locking screw 36 being released, it is possible for the support 2, on account of the displaceable mounting of the sliding block 38 in the longitudinal profile groove 39, to be displaced along the tube 3 and then fastened again by virtue of the locking screw 36 being tightened.

The two glass panels 21, 22 are retained carefully by the elastic rings (not illustrated specifically) in the annular grooves 27, 28, 29, 30 and by bearing on the eccentric sleeve, which acts as a spacer sleeve. The bores 25, 26 and the extent of the retaining legs 4, 5 are selected such that the distance a1 of the panel 21 from a parallel plane which intersects the center axis M is equal to the distance a2 of the glass panel 22 from a plane which is parallel to this glass panel and runs through the center axis M of the tube 3. Precision setting can be carried out here by virtue of the nuts 15, 42 and 16, 43 being turned. The arrangement is symmetrical in relation to the angle bisector W of the support 2, with the result that the air gap 41 is bisected by said angle bisector W. This means that, in relation to this direction W, the air gap 41 is located directly and centrally in front of the supporting tube 3, with the result that an air stream which reaches the air gap 41 frontally reaches the supporting tube 3 centrally, where it is deflected. Here too, adjustment in the direction of the arrows P, P' is possible by virtue of the eccentric sleeves 23, 24 being rotated.

Figure 2:
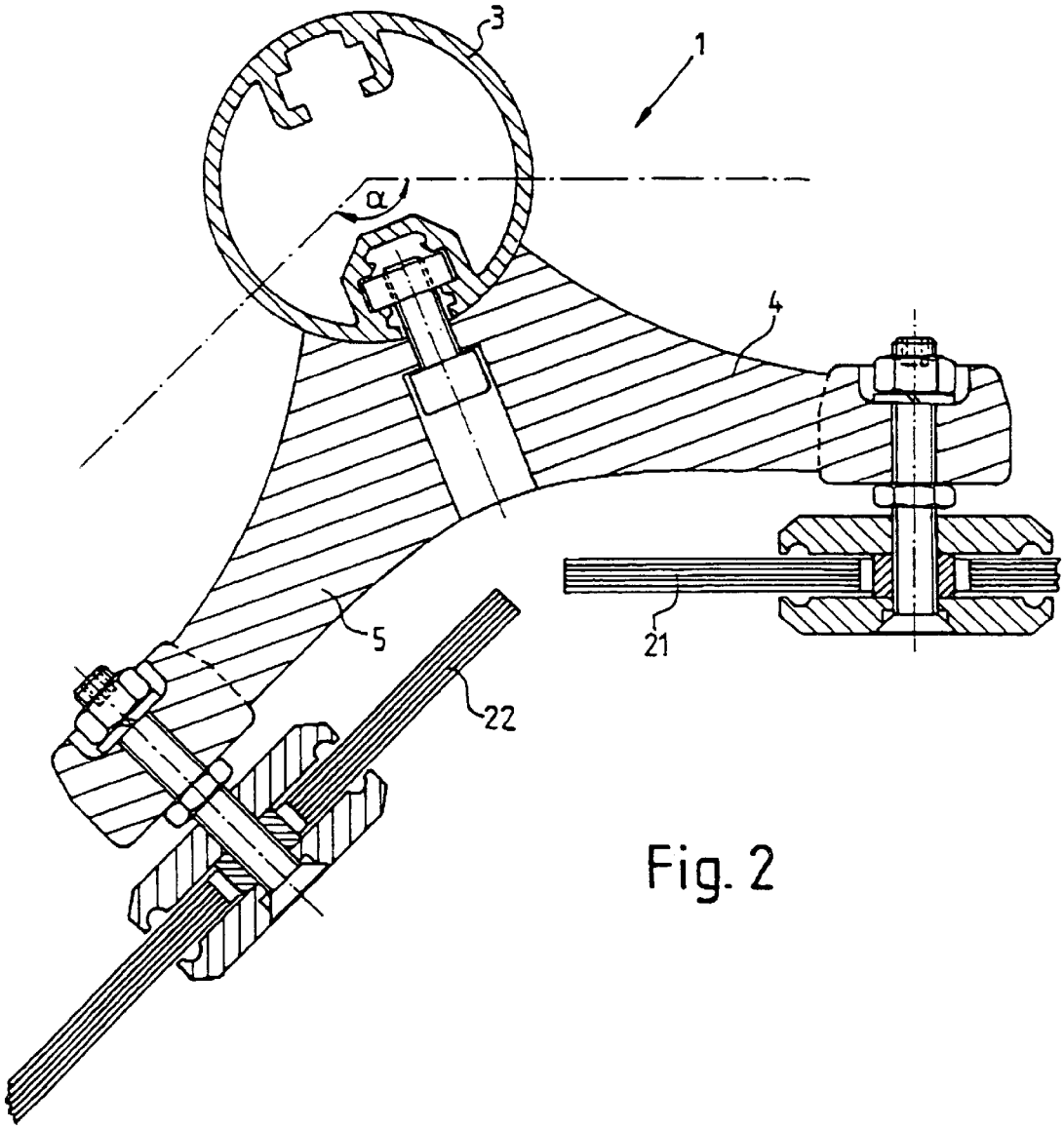
FIG. 2 shows an arrangement according to the invention angled at 45° away from the supporting tube.
Figure 3:
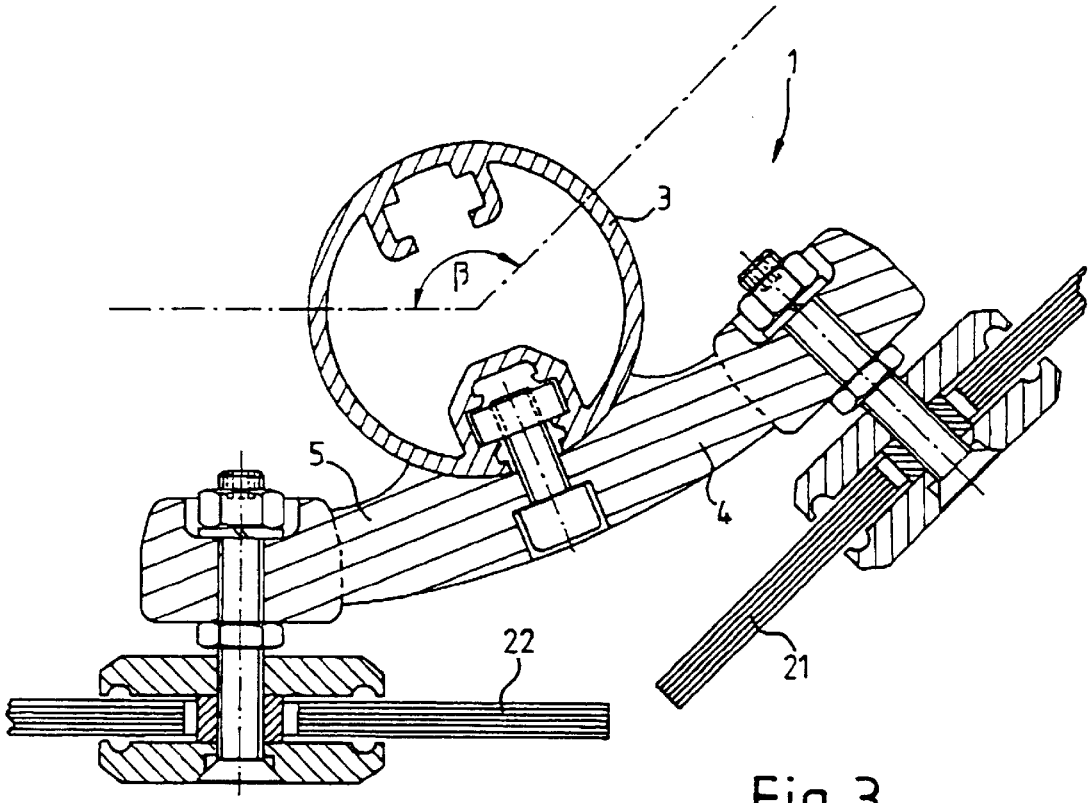
FIG. 3 shows an arrangement according to the invention angled at 45° toward the supporting tube.

The exemplary embodiments according to FIGS. 2 and 3 essentially correspond to the exemplary embodiment described above. They differ, however, in the arrangement of the retaining legs 4, 5, as a result of which it is possible to set different angles between the glass panels 21, 22. Thus, for example, the support 2 according to the FIG. 1 sets a right angle a between the glass panels 21, 22 which is oriented outward, as seen from the side of the supporting tube 3. The support 2 according to FIG. 2 produces an angle of 45° between the glass panels 21, 22 which is likewise directed outward (as seen from the supporting tube 3).

Figure 4:
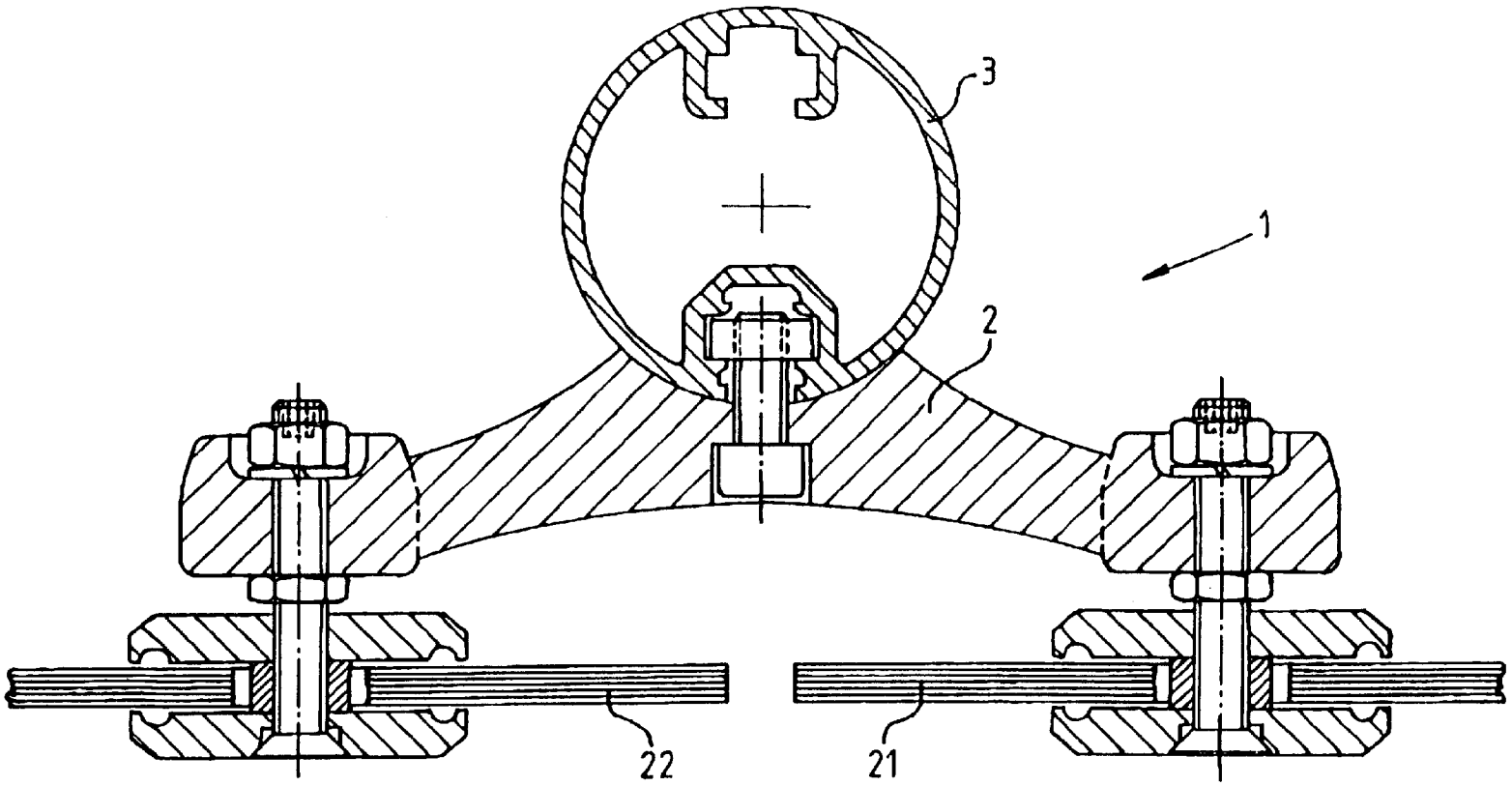
FIG. 4 shows an arrangement positioned at 180°.
Figure 5:
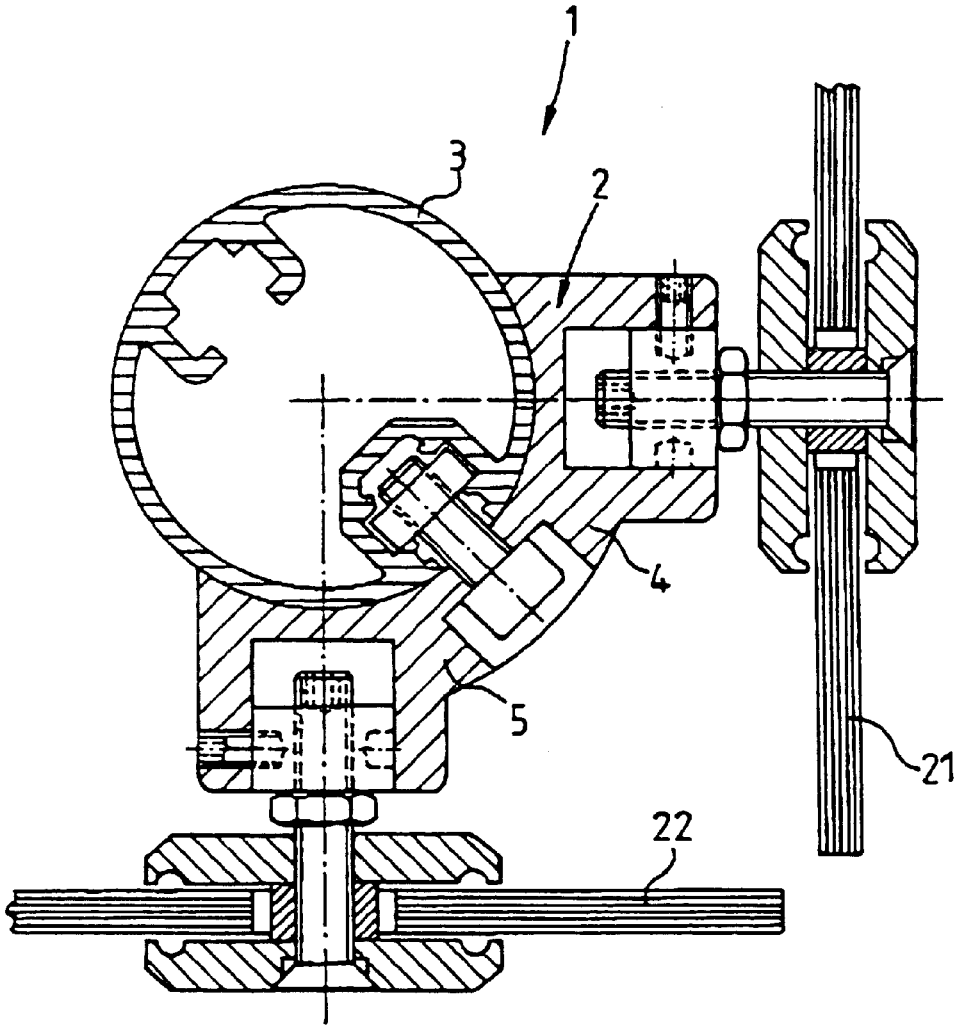
FIG. 5 shows an arrangement angled at 90° toward the supporting tube.

FIG. 3, in turn, produces a 45° angle β in the direction of the supporting tube 3 between the glass panels 21 and 22. Corresponding to the three exemplary embodiments mentioned, FIG. 4 illustrates an arrangement according to the invention in the case of which the glass panels 21, 22 are located at 180° in rectilinear extension of one another. It is also possible in an analogous manner for the glass panels to be arranged at any other desired angle.

As can be seen from FIGS. 1 to 4, the respective distances a1 and a2 of the glass panels 21 and 22 from a plane which intersects the center axis of the supporting tube 3 and runs parallel to the glass panels 21 and 22 are equal. It is also the case that the distances of the glass bores 24, 25 from the border of the glass or the air gap 41 are always arranged with the same unit spacing. It is likewise the case that the angles are provided such that the angle bisector W more or less always intersects the center axis M of the supporting tube 3. As a result, it is not just the case that the supporting tube 3 is located level with the air gap 41, in relation to the air flow which reaches the air gap 41 frontally; it is also located symmetrically and centrally in relation to said flow direction along the angle bisector W, this resulting in optimum action as an obstruction to air. It is also possible to have an overlapping arrangement of adjacent panels 21, 22 on account of the possibility of adjusting the panel distance a1, a2 from the supporting tube 3 by virtue of the screw nuts 16, 43 and 15, 42.

Figure 6:
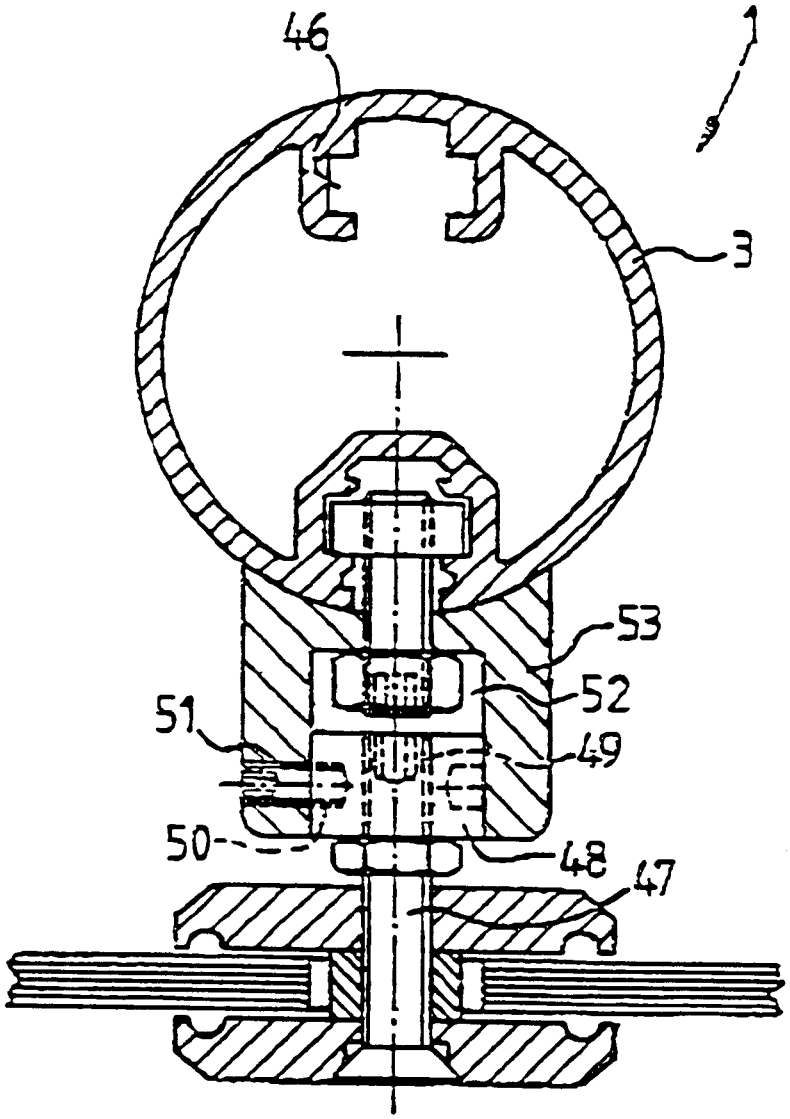
FIG. 6 shows an arrangement according to the invention serving as an end termination.

The arrangement according to FIG. 6 corresponds to the exemplary embodiments mentioned above, although in the present case the support 53 does not have any legs 4, 5. This logically means that the support 53 can also only be used for fastening a panel as an end termination. Unlike the previously described embodiments, the retaining bolt 47 in this case is screwed into a receiving block 48 with internal thread 49. Via transverse bores 50 of the receiving block 48 and corresponding transverse bores 51, which in some cases are provided with an internal thread, the receiving block 48 is fixed in a receiving bore 52 of the support 53 by means of a screw (not illustrated specifically). The securing system otherwise corresponds to the exemplary embodiments mentioned above.

Figure 7:
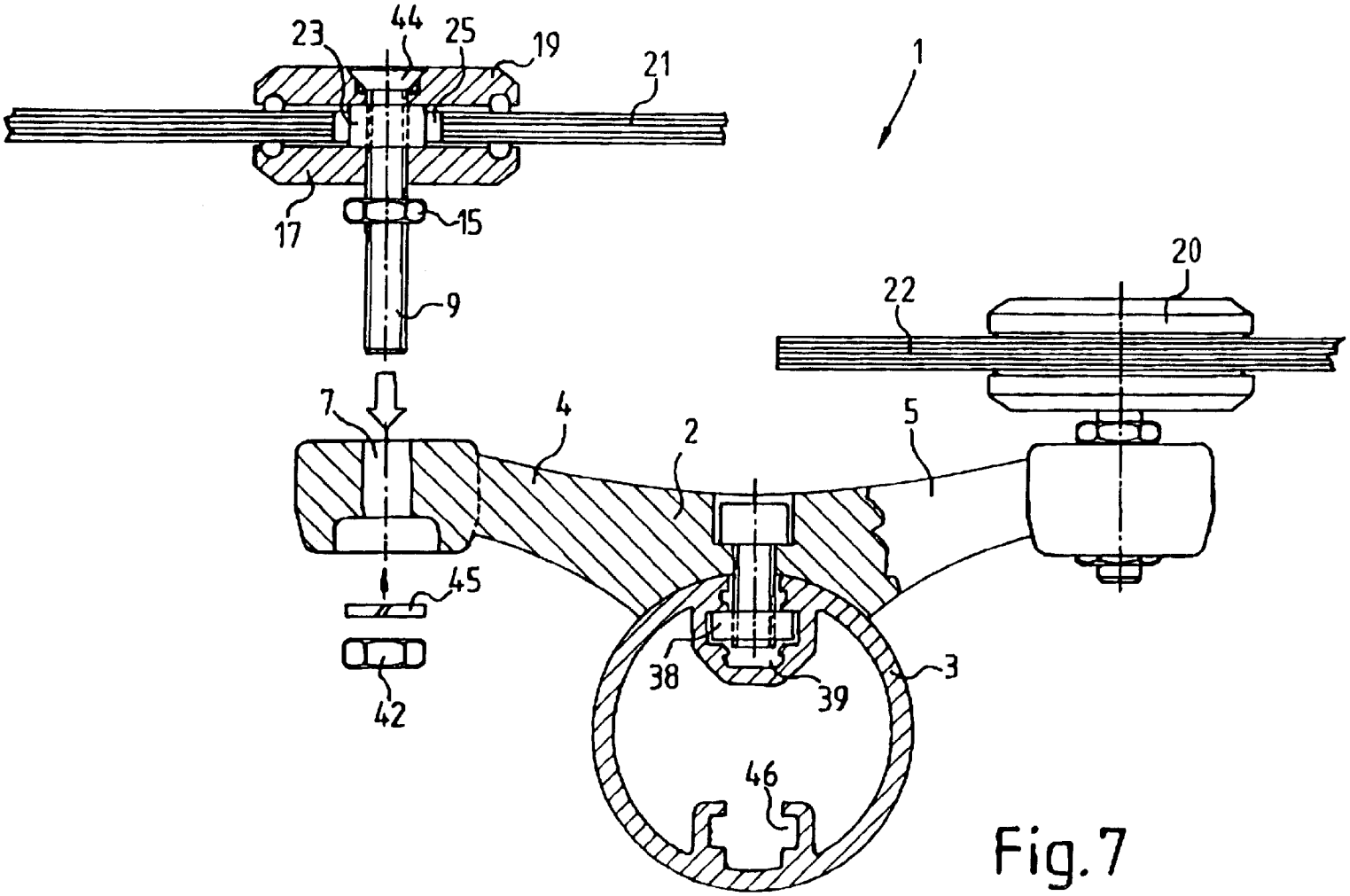
FIG. 7 shows an illustration of the assembly of an arrangement according to the preceding figures.

FIG. 7 illustrates the assembly of an arrangement 1 according to the invention. First of all, the retaining bolt 9 is inserted through the outer retaining element 19, the head 44 being received in an appropriate recess of the retaining element 19 so as to produce a flush outer surface. Then the eccentric sleeve 23, which in this case has an internally threaded bore, is screwed onto the retaining bolt 9.

Thereafter, the structural unit comprising retaining bolt 9, eccentric sleeve 23 and outer retaining element 19 is positioned in the desired eccentrically rotated position in the bore 25 of the glass panel 21. The glass panel 21 thus rests centrally at the highest point of the eccentric sleeve 23 (on account of the circular bore 25). Then the inner retaining element 17, which likewise contains an internal thread, is screwed onto the retaining bolt 9. The intended distance from the support 2 is then set with the aid of the nut 15 and, subsequently, the entire unit is inserted, with the retaining bolt 9, through the bore 7 of the retaining leg 4. The arrangement 1 is then fixed by virtue of a securing ring 45 and the screw nut 42 being screwed on. The glass panel 22 is illustrated as already having been installed on the retaining leg 5.

The height of the support 2 can be set, as has been described, via the guidance of the sliding block 38 in the longitudinal profile groove 39.

The opposite side of the supporting tube 3 has an inner reinforcing longitudinal profile 46. This profile 46 serves, on the one hand, for improving the rigidity of the supporting tube 3 and can be used as an additional installation or guide profile for further structural units, e.g. made of flat material. In this case, the tube wall has to be bored or cut open in the appropriate region, with the result that the groove 46 is accessible from the outside.

Figure 9:
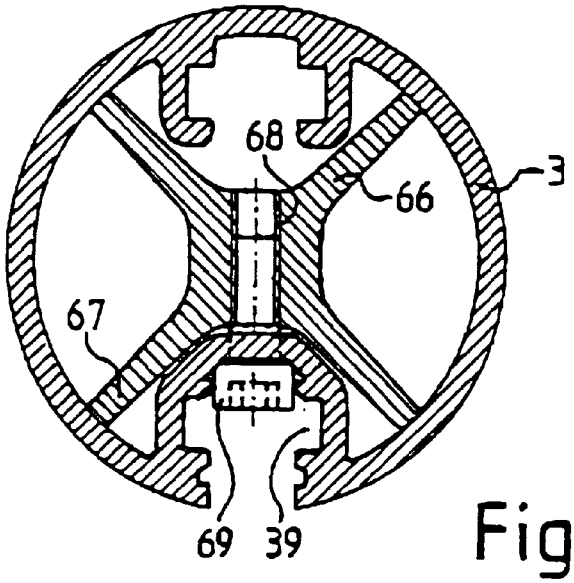
FIG. 9 shows a cross section through a supporting tube according to FIG. 8.
Figure 8:
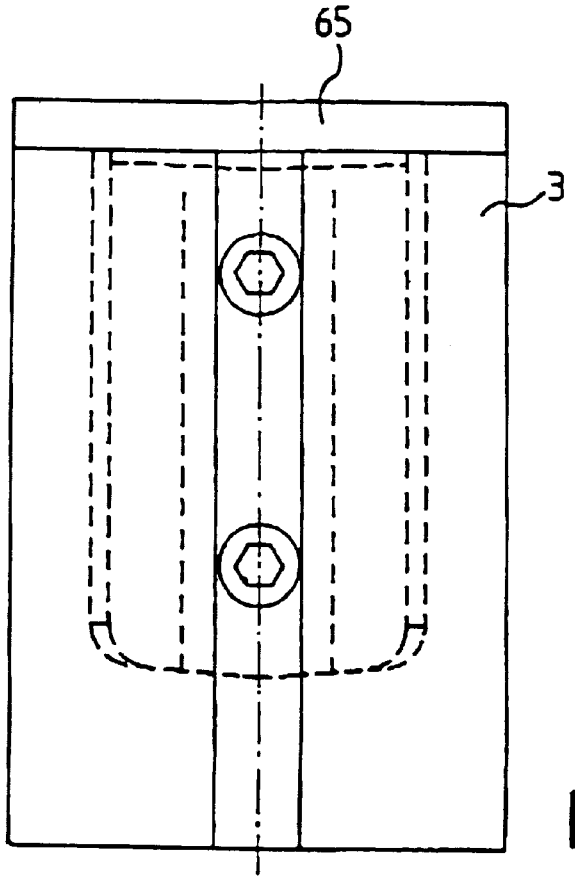
FIG. 8 shows a side illustration of a supporting tube with an end-side covering placed in position.

FIGS. 8 and 9 illustrate an end-side covering 65 which closes off the supporting tube 3 on the end side. This avoids the situation where moisture or dirt can pass into the interior of the supporting tube 3, an aesthetically pleasing tube termination being provided in addition. The covering 65 is provided with an insertion profile 66, of which the guide webs 67 butt against the tube 3 on the inside. The insertion profile 66 is screw-connected via one or more threaded bores 68, the fastening screws 69, in turn, being countersunk in the interior of the longitudinal groove 39.

It is also possible for further measures (not illustrated specifically) for securing the covering 65 in a fitting and play-free manner, for example the use of spring-type straight pins or tapered pins which are driven into appropriately offset bores or other measures which are conventional in metal construction, to be used in addition to, or even instead of, the screwed-connection 69.

Figure 10:
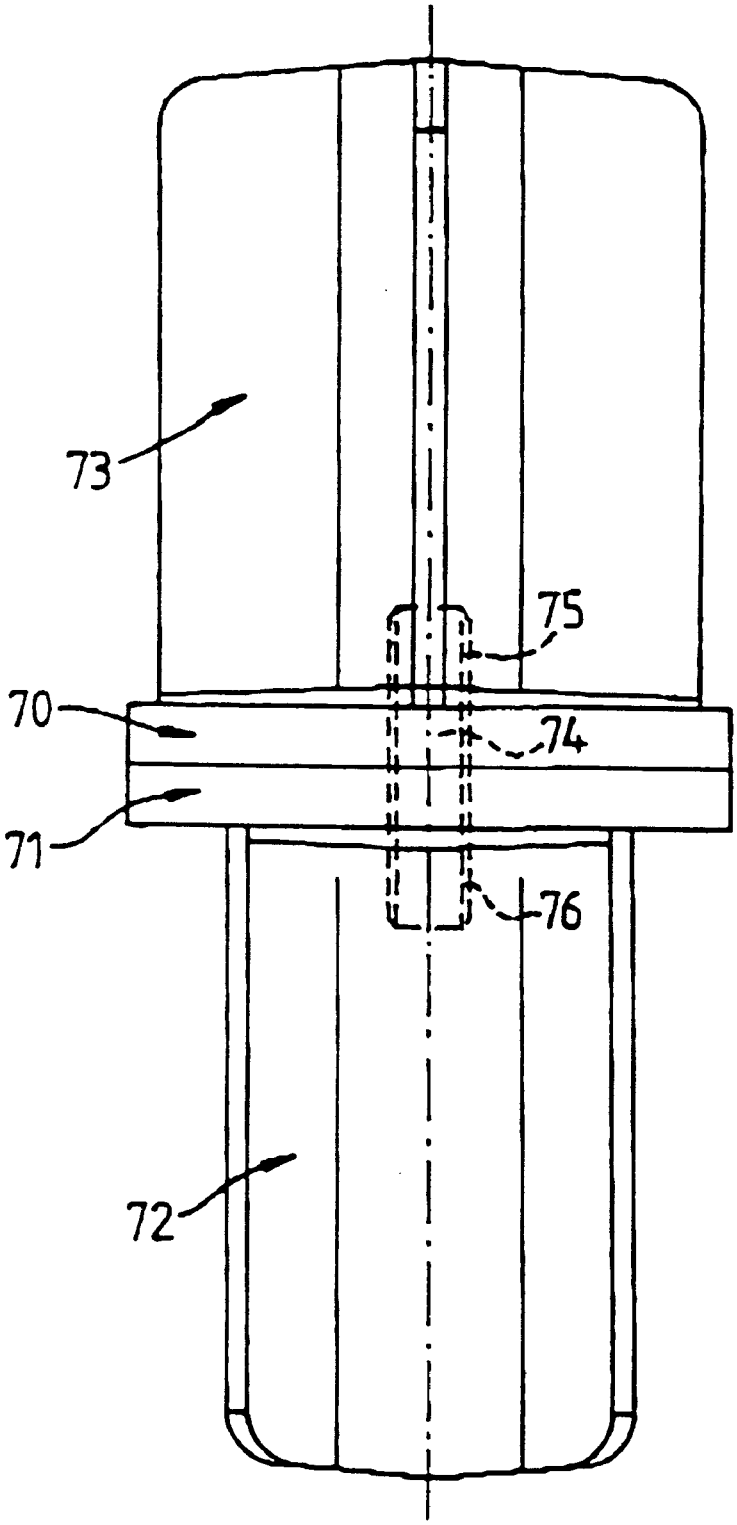
FIG. 10 shows two end-side connection parts which can be connected rotatedly to one another.

The illustration according to FIG. 10 shows the use of two coverings 70, 71 with corresponding insertion profiles 72, 73. The two coverings 70, 71 can be rotated in relation to one another and fastened on one another. This is possible, for example, by virtue of a threaded rod 74 being screwed into appropriate threaded bores 75, 76 in the coverings 70, 71. This makes it possible for two supporting tubes 3 to be fastened at the end sides in extension of one another, the longitudinal grooves 39 being rotated in relation to one another in accordance with the rotation between the coverings 70, 71. This makes it possible to rotate the retaining plane of the glass panels which are to be fastened on the supporting tubes 3.

Figure 11:
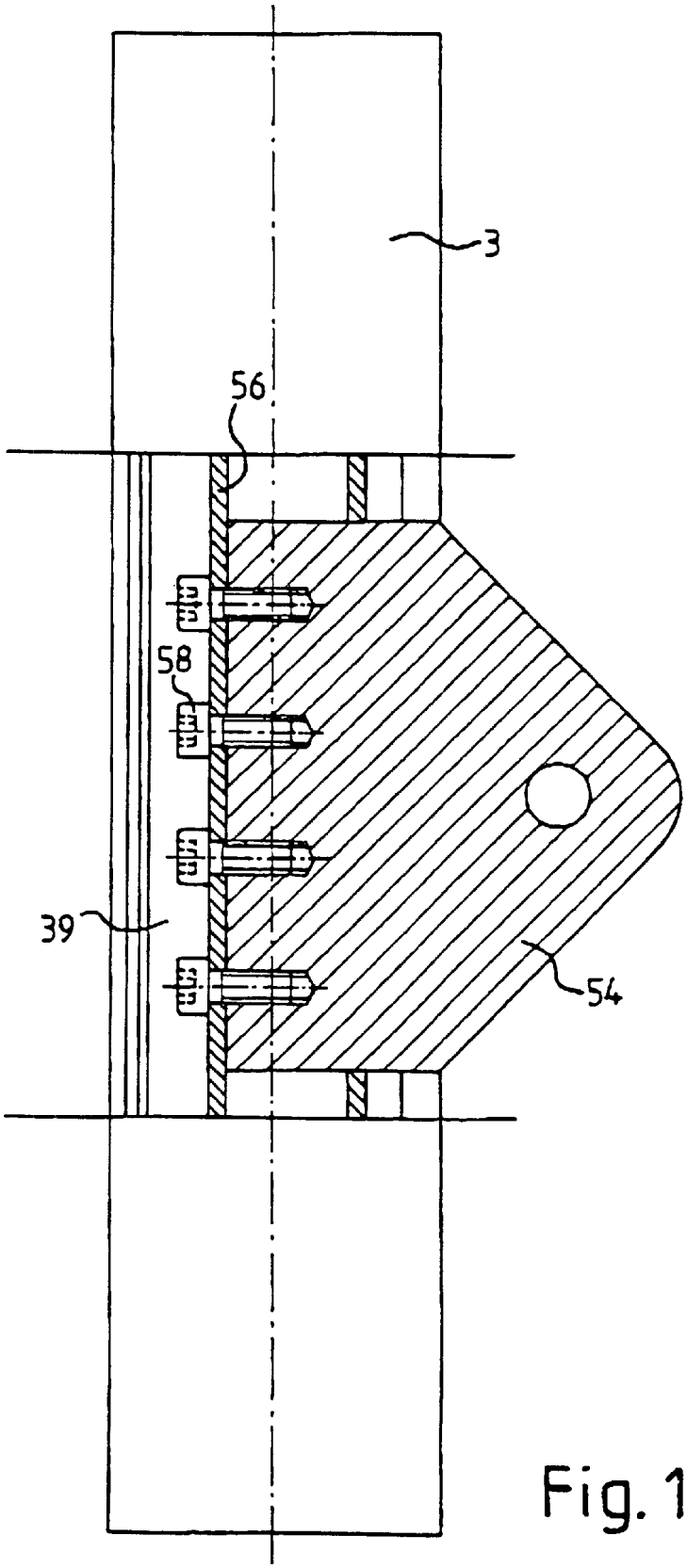
FIG. 11 shows a partial section through a supporting tube according to the invention with an additionally provided retaining plate.
Figure 12:
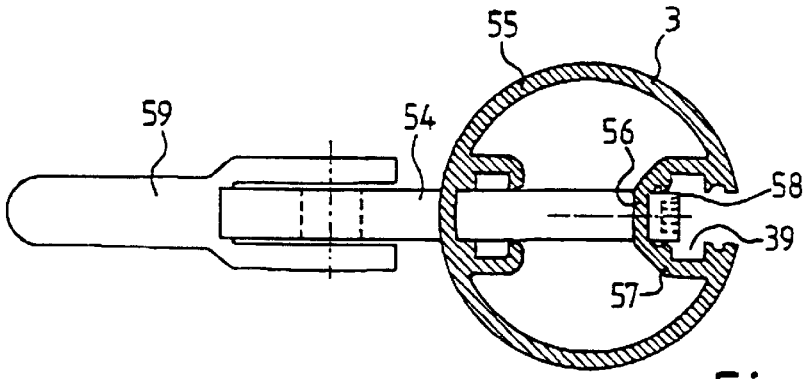
FIG. 12 shows a cross section through a supporting tube according to FIG. 11.
Figure 13:
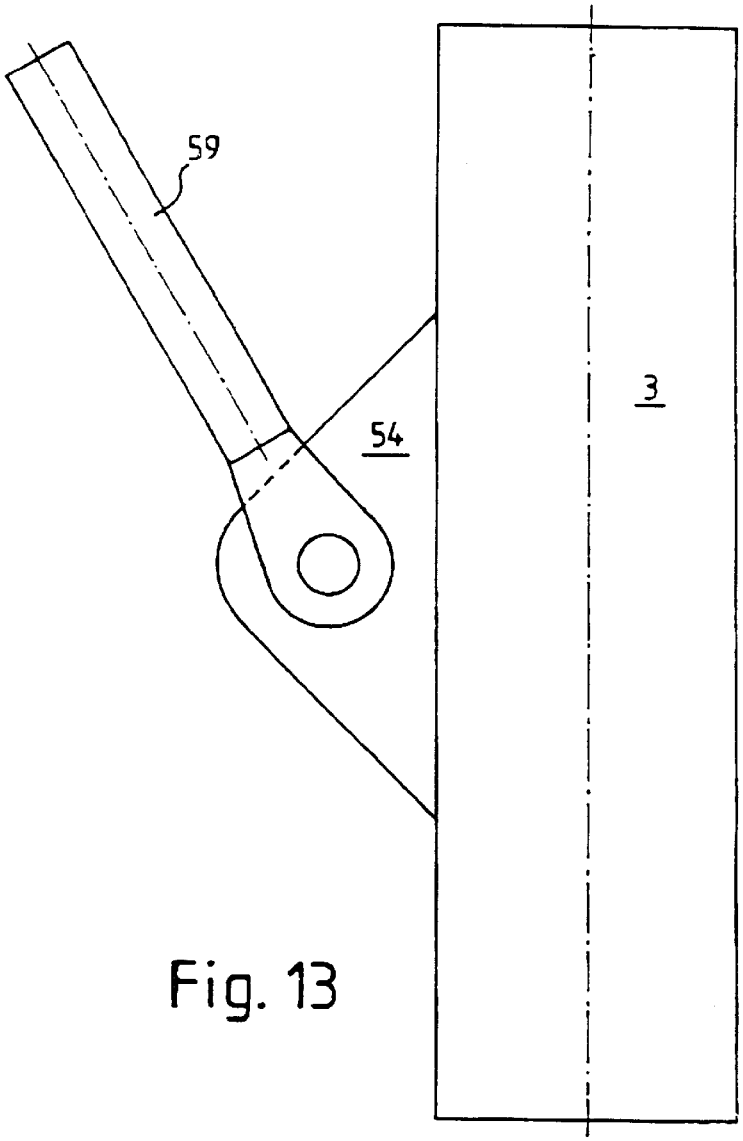
FIG. 13 shows a side view of a supporting tube with retaining plate and tension bar.

FIGS. 11 to 15 illustrate exemplary embodiments for using the inner reinforcing profile 46. FIGS. 11 to 13 show the fastening of a coupling ring 54 on that side of the supporting tube 3 which is located opposite the longitudinal groove 39. For this purpose, the tube wall 55 is notched to the extent where the ring 54 can be pushed in. By virtue of the design of the reinforcing profile 46 as a profile which is open toward the interior of the supporting tube 3, the coupling ring 54 can be inserted until it passes through the reinforcing profile 46 and strikes against the transverse web 56 of the profile 57, which forms the longitudinal profile groove 39. The coupling ring 54 may then be screw-connected in the interior of the longitudinal profile groove 39, with the result that the screws 58 are countersunk in the interior of the supporting tube 3.

A tension rod 59, for example, may be fastened, in the present exemplary embodiment rotatably, on the coupling ring 54.

Figure 15:
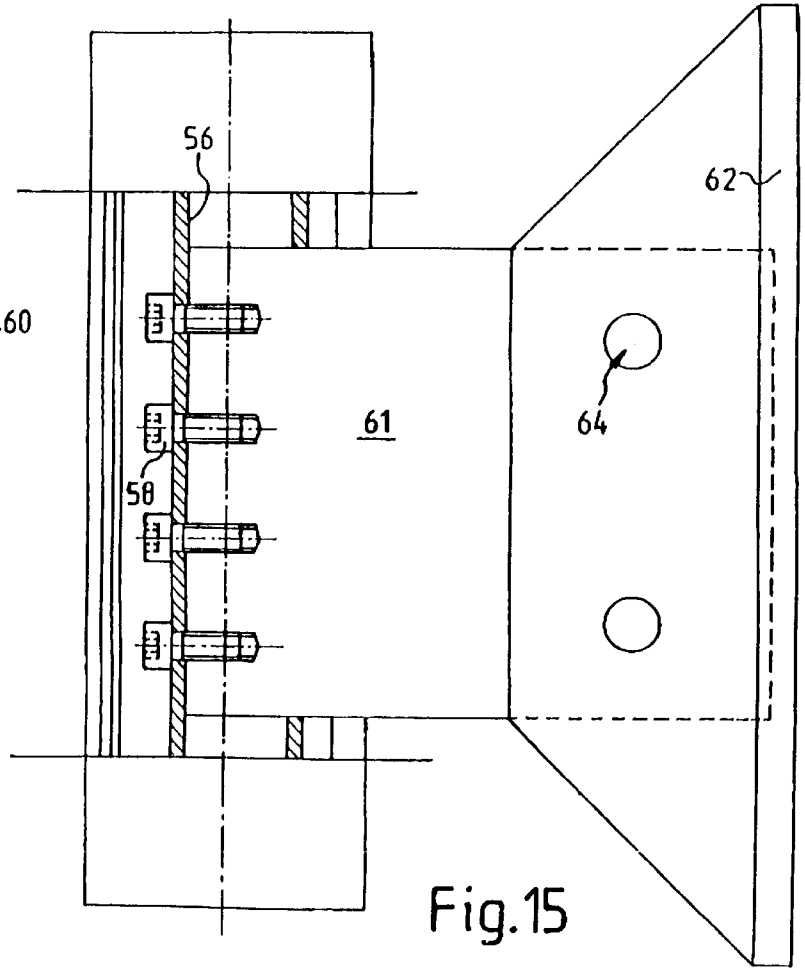
FIG. 15 shows a cross section in the longitudinal direction through a supporting tube according to FIG. 14.
Figure 14:
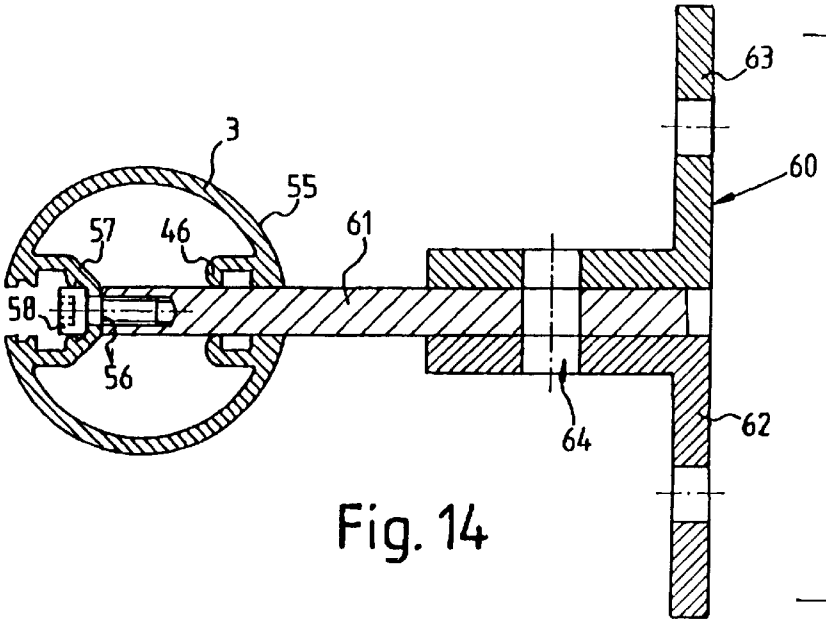
FIG. 14 shows a cross section through a supporting tube with wall fastening.

Other additional fastening elements may be fastened on the supporting tube 3 in an analogous manner. Thus, as a further exemplary embodiment, FIGS. 14 and 15 illustrate how a wall fastening 60 may be provided on a supporting tube 3. In this embodiment, a securing plate 61, in turn, is inserted through the tube wall 55 by way of an appropriate notched-out portion and, finally, through the reinforcing profile 46 and, in turn, is screw-connected on the transverse web 56 of the longitudinal-groove-forming profile 57 by screws 58. Two fastening angles 62, 63 are fastened, for example screw-connected in the through-passage bore 64, on either side of the securing of the securing plate 61. The fastening angles 62, 63, in turn, are fastened, for example dowel-jointed, on any desired wall. This variant shows how, for example, a glass cladding or a glass facade can be erected in front of a building wall. Of course, the wall fastening 60 may be provided not just on continuous walls but also on posts or other structural elements of a building.

Figure 16:
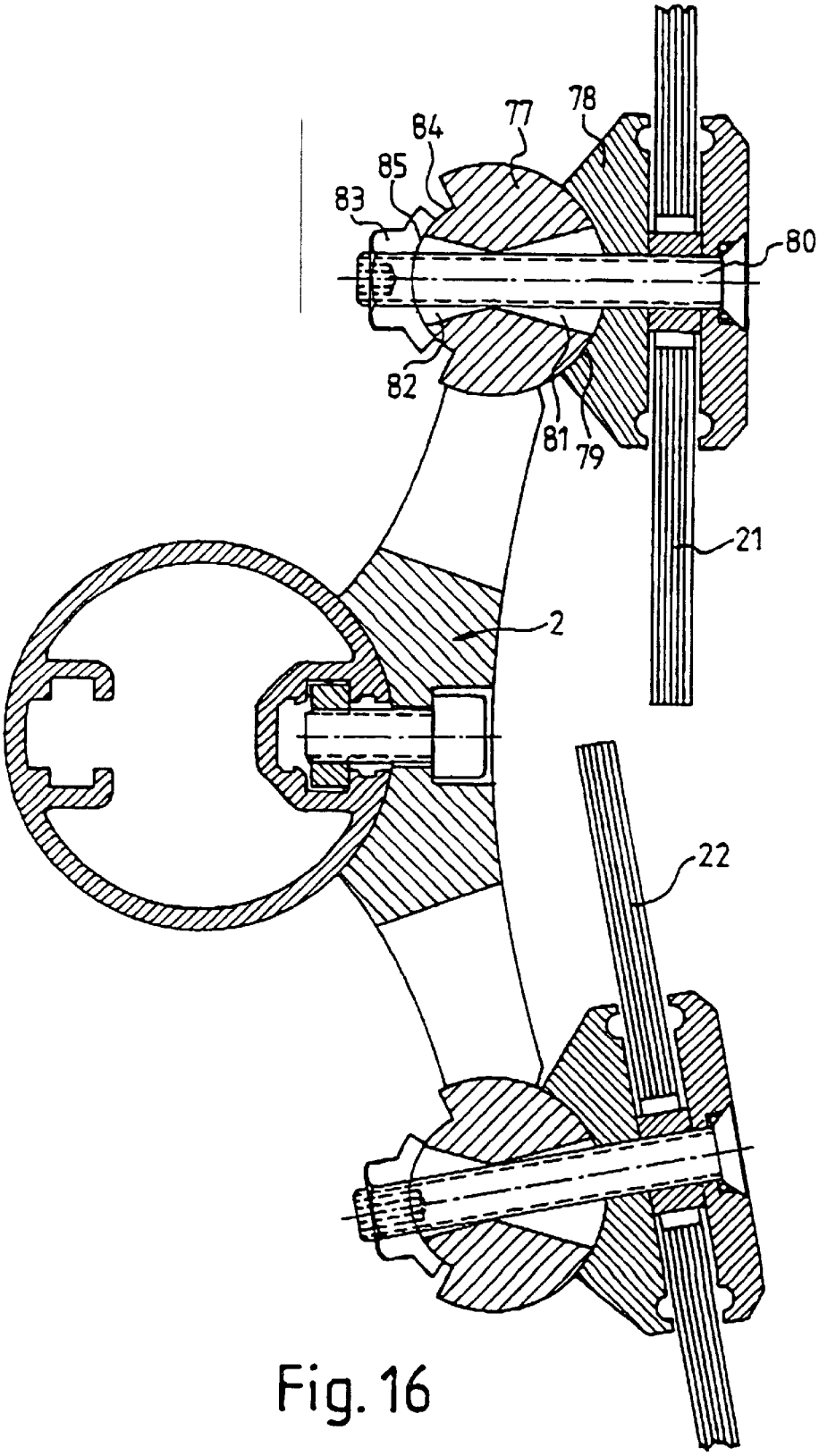
FIG. 16 shows a cross section through a support with panel-securing means which can be rotated.

FIG. 16, in turn, shows a possible way of rotating the glass panels 21, 22 in the support 2. The a support 2 is provided with a receiving means 77 with a circle-segment-like cross section. A glass-retaining means 78 is provided with a bearing 79 which can be positioned on the receiving means 77 in a positively locking manner.

The glass-retaining means 78 is fixed on the receiving means 77 by a locking screw 80 which is inserted into two conical bores 81, 82 and is locked via a lock nut 83, which in this case has a bearing surface 85 which is curved to fit the locking surface 84 of the receiving means 77. With the aid of the support 2 according to FIG. 11, it is thus possible to set any desired angle within a predetermined angle range for the glass panels 21, 22.

In the case of basic cylindrical shapes for the receiving means 77 and the bearing 79, rotatability about the cylinder axis is thus provided, and in the case of spherical design, the orientation of a glass panel 21, 22 may be adjusted as desired.

Figure 17:
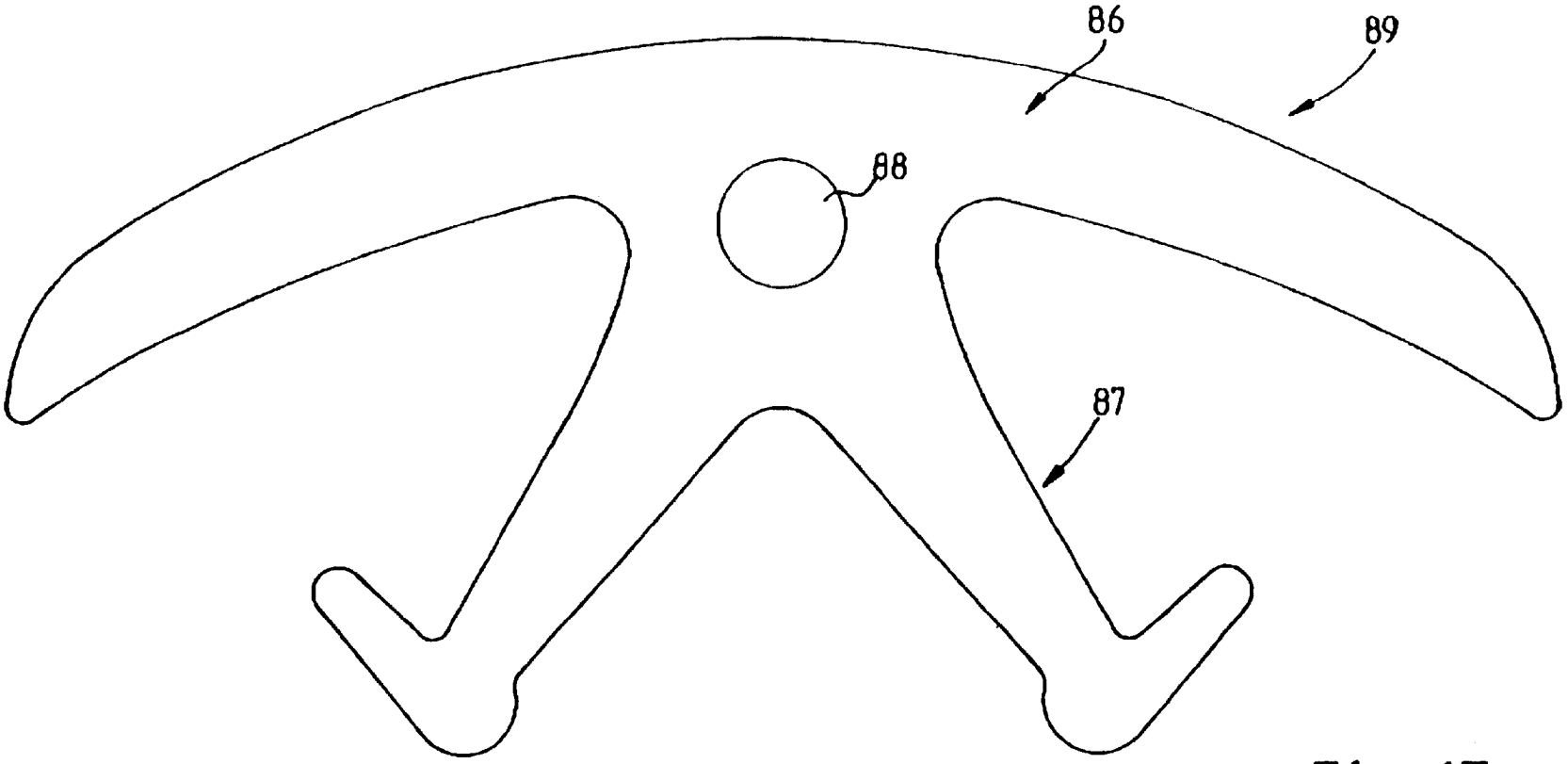
FIG. 17 shows an end view of a covering profile for the opening slot of a supporting tube.

Following installation of all of the envisaged structural elements, the longitudinal profile groove 39 is preferably closed by a covering profile, for example a profile according to FIG. 17. The profile according to FIG. 17 comprises a top section 86 which serves for closing off a longitudinal groove on the outside. With the aid of a latching section 87, the covering profile 89 can be latched in a longitudinal groove 39. A guide opening 88 serves for fixing the covering profile 89 on the end side, for example by way of a retaining pin (not illustrated specifically) of an end-side covering 65, 70, 71, as described above, or else of a covering for a butt joint (said covering not being illustrated specifically), for example for forming a construction from longitudinal and transverse supports. Such a butt joint is preferably formed via two half-shells with appropriate openings for supporting tubes 3, which form a closed junction point for various supporting tubes 3.

The covering profile 89 is preferably formed from rubber, but other, preferably elastic and sealing, materials such as Teflon etc. are also conceivable.

A construction of the type described above can be used to erect cost-effectively a wide range of different structures with panel-like material without fixed framing. The supporting tube 3 with the longitudinal slot according to the invention or the longitudinal profile groove 39 according to the invention allows a very great amount of flexibility for fastening supports 2 or other retaining elements 59, 61.

As has already been mentioned a number of times, an arrangement according to the invention may also be used for securing insulating glass, i.e. laminated safety glass.

The arrangement according to the invention can be used for a wide range of applications. It can be used, in particular, for walkway canopies, trade-fair halls, passageways, shelters, winter protection for stairways, tunnels etc. and for erecting stands in trade-fair construction.

As has likewise already been mentioned a number of times, seals or sealing profiles, for example made of rubber or aluminum, are conceivable for the erection of a sealed construction without air gaps.

An arrangement according to the invention can be used not just for terraces and balconies of private houses and public buildings, for example in inns or restaurants or the like; it is also possible, for example by means of a construction according to the invention, for a house facade to be protected against weathering and nevertheless to remain visible from the outside. It is also possible to realize pedestrian passageways and much more using an abovedescribed open glass construction with a securing arrangement according to the invention. Since the invention is suitable not just for glass panels but also for other types of panels, it is also possible for non-glazed structures or partially glazed structures to be erected therewith.

It is also easily possible for an individual to erect an arrangement according to the invention himself/herself. For this purpose, it is conceivable to provide corresponding kits which are available in DIY stores or similar sales outlets. High-outlay installation, as in the case of conventional conservatories, is dispensed with, as has already been mentioned a number of times.

List of designations:

| | |
|---|---|
| 1 | Arrangement |
| 2 | Support |
| 3 | Supporting tube |
| 4 | Retaining leg |
| 5 | Retaining leg |
| 6 | Tube-side section |
| 7 | Bore |
| 8 | Bore |
| 9 | Retaining bolt |
| 10 | Retaining bolt |
| 11 | Reinforcement |
| 12 | Reinforcement |
| 13 | Recess |
| 14 | Recess |
| 15 | Nut |
| 16 | Nut |
| 17 | Retaining disks |
| 18 | Retaining disks |
| 19 | Retaining disks |
| 20 | Retaining disks |
| 21 | Glass panel |
| 22 | Glass panel |
| 23 | Eccentric sleeve |
| 24 | Eccentric sleeve |
| 25 | Bore |
| 26 | Bore |
| 27 | Annular groove |
| 28 | Annular groove |
| 29 | Annular groove |
| 30 | Annular groove |
| 31 | Bore |
| 32 | Annular shoulder |
| 33 | Cross-sectional widening |
| 34 | Section |
| 35 | Screw head |
| 36 | Locking screw |
| 37 | Section |
| 38 | Sliding Block |
| 39 | Profile groove |
| 40 | Bearing surface |
| 41 | Air gap |
| 42 | Screw nut |
| 43 | Screw nut |
| 44 | Head |
| 45 | Securing ring |
| 46 | Reinforcing profile |
| 47 | Retaining bolt |
| 48 | Receiving block |
| 49 | Internal thread |
| 50 | Transverse bore |
| 51 | Transverse bore |
| 52 | Receiving bore |
| 53 | Support |
| 54 | Coupling ring |
| 55 | Tube wall |
| 56 | Transverse web |
| 57 | Profile |
| 58 | Screw |
| 59 | Tension rod |
| 60 | Wall fastening |
| 61 | Securing plate |
| 62 | Fastening angle |
| 63 | Fastening angle |
| 64 | Through-passage bore |
| 65 | Covering |
| 66 | Insertion profile |
| 67 | Guide web |
| 68 | Threaded bore |
| 69 | Screw |
| 70 | Covering |
| 71 | Covering |
| 72 | Insertion profile |

-continued

| List of designations: | |
|---|---|
| 73 | Insertion profile |
| 74 | Threaded rod |
| 75 | Threaded bore |
| 76 | Threaded bore |
| 77 | Receiving means |
| 78 | Glass-retaining means |
| 79 | Bearing |
| 80 | Locking screw |
| 81 | Conical bore |
| 82 | Conical bore |
| 83 | Locking nut |
| 84 | Locking surface |
| 85 | Bearing surface |
| 86 | Top section |
| 87 | Latching section |
| 88 | Guide bore |
| 89 | Covering profile |

What is claimed is:

1. An arrangement for securing at least one panel of panel-like material for erecting structures or parts of structures, comprising:

a support adapted to retain the at least one panel;

a supporting tube having a profile groove which is arranged in the interior of the supporting tube and has a longitudinal slot;

a retaining element fastenable in the longitudinal slot in order to secure the support;

wherein an inner longitudinal profile is provided in the interior of the supporting tube opposite the profile groove, the inner longitudinal profile having an inner longitudinal slot.

2. The arrangement according to claim 1, wherein the panel-like material is at least one of glass panels and wooden panels.

3. The arrangement according to claim 1, wherein in a region of the longitudinal profile, a wall of the supporting tube is provided with a notched-out portion.

4. The arrangement according to claim 1, further comprising fastening elements inserted through the inner longitudinal profile by way of notched-out portions.

5. The arrangement according to claim 4, wherein the fastening elements are fixed on the profile groove via additional retaining elements.

6. The arrangement according to claim 1, wherein the profile groove is undercut.

7. The arrangement according to claim 3, wherein the profile groove is undercut.

8. The arrangement according to claim 4, wherein the profile groove is undercut.

9. The arrangement according to claim 1, wherein the retaining element is a sliding block.

10. The arrangement according to claim 1, wherein the support is fastened displaceably on the supporting tube.

11. The arrangement according to claim 1, further comprising a covering profile provided for covering the longitudinal slot.

12. The arrangement according to claim 1; further comprising an end-side covering provided for the supporting tube.

13. The arrangement according to claim 1, further comprising an additional supporting tube and two end-side coverings, a respective one of said end-side coverings being provided for one of the supporting tubes, the two end-side coverings being fastened on one another.

14. The arrangement according to claim 1, further comprising:

an additional supporting tube;

end-side coverings rotatable in relation to one another, the two supporting tubes being fastened at the end sides by means of the end-side coverings with the longitudinal slots rotated in relation to one another.

15. The arrangement according to claim 1, further comprising sealing profiles provided for sealing an interspace between two panels retained on a supporting tube via the support.

16. A supporting tube for securing a support for at least one glass panel, wherein the supporting tube has a profile groove which is arranged in an interior of the supporting tube and has a longitudinal slot on which a retaining element is fastenable in order to secure the support, wherein an inner longitudinal profile is provided in the interior of the supporting tube opposite the profile groove, the inner longitudinal profile having an inner longitudinal slot.

17. A structure, comprising:

panel-like materials;

an arrangement for securing the panel-like materials, the arrangement comprising:

a support adapted to retain at least one panel of the panel-like materials;

a supporting tube having a profile groove which is arranged in the interior of the supporting tube and has a longitudinal slot;

a retaining element fastenable in the longitudinal slot in order to secure the support;

wherein an inner longitudinal profile is provided in the interior of the supporting tube opposite the profile groove, the inner longitudinal profile having an inner longitudinal slot.

18. A method of producing a structure using panel-like material, the method comprising the acts of:

retaining at least one panel of the panel-like material on a supporting tube via a support;

securing the support on the supporting tube via a retaining element, the supporting tube having a profile groove which is arranged in the interior of the supporting tube and has a longitudinal slot on which the retaining element is fastened;

providing an inner longitudinal profile in the interior of the supporting tube opposite the profile groove, the inner longitudinal profile having an inner longitudinal slot.

* * * * *